United States Patent [19]

Robbins et al.

[11] 4,420,188

[45] Dec. 13, 1983

[54] DOUBLE SHIELD TUNNEL BORING MACHINE

[75] Inventors: Richard J. Robbins; David T. Cass, both of Seattle, Wash.

[73] Assignee: The Robbins Company, Kent, Wash.

[21] Appl. No.: 325,101

[22] Filed: Nov. 27, 1981

Related U.S. Application Data

[63] Continuation-in-part of Ser. No. 802,878, Jun. 2, 1977, abandoned, which is a continuation of Ser. No. 677,709, Apr. 16, 1976, abandoned, which is a continuation of Ser. No. 481,292, Jun. 20, 1974, abandoned.

[51] Int. Cl.[3] ..... E21D 9/08

[52] U.S. Cl. ..... 299/31; 299/33; 405/143

[58] Field of Search ..... 299/31, 33; 405/143; 175/94

[56] References Cited

U.S. PATENT DOCUMENTS 3,203,737 8/1965 Robbins et al. ..... 299/31

FOREIGN PATENT DOCUMENTS 1206938 12/1965 Fed. Rep. of Germany ..... 299/31
1271744 7/1968 Fed. Rep. of Germany ..... 299/31
384612 2/1965 Switzerland ..... 299/31

*Primary Examiner*—William F. Pate, III
*Attorney, Agent, or Firm*—John O. Graybeal

[57] ABSTRACT

Front and rear shields are telescopically joined together. The front shield carries a power driven rotary cutterhead means. Thrust rams are provided between the two shields for pushing the forward shield forwardly relative to the rear shield while the cutterhead means is being operated to mine the tunnel face, and also to pull the rear shield forwardly relative to the front shield. The rear shield includes a gripper assembly for reacting thrust and torque and a plurality of auxiliary thrust rams which extend rearwardly from the rear shield to react against forward end portions of a tunnel lining which is erected under cover of a tail section of the rear shield. A pair of side placed torque cylinders are interconnected between frame portions of the two shields and serve to transmit counter-rotational torque from the cutterhead support of the front shield back to the rear shield. The torque cylinders are adapted to accommodate relative axial movement between the two shields and are operable to roll the shields back into proper position after they have been rolled out of position by the counter-rotational torque generated by rotation of the cutterhead means.

19 Claims, 17 Drawing Figures

10
12
14
15
16
18
20
22
24
26
28
30
32
34
36
38
40
42
43
44
46
48
50
52
54
56
58
60
62
64
66
68
70
72
74

18
20
24

Fig. 11.
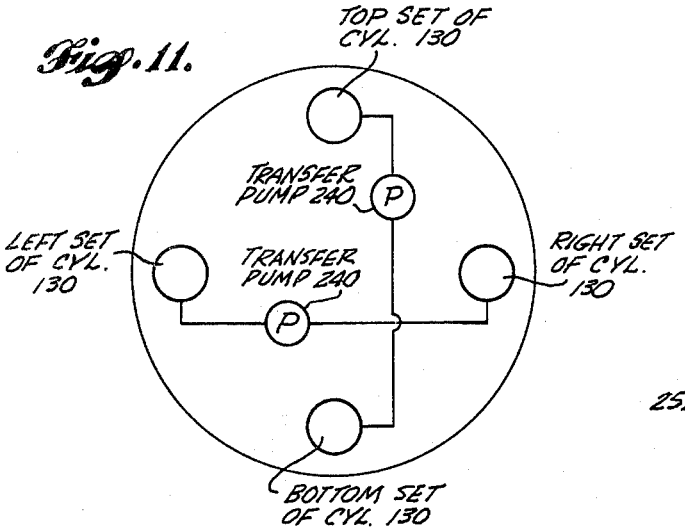
Fig. 12.
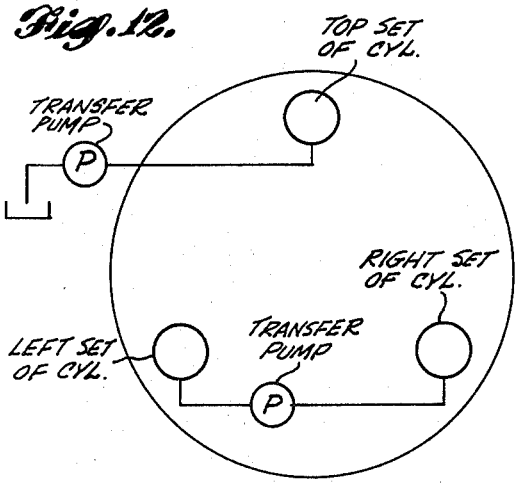
Fig. 13.
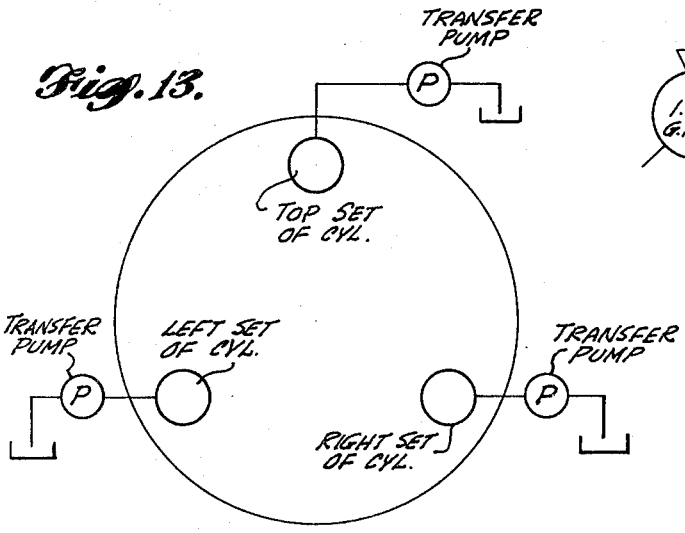
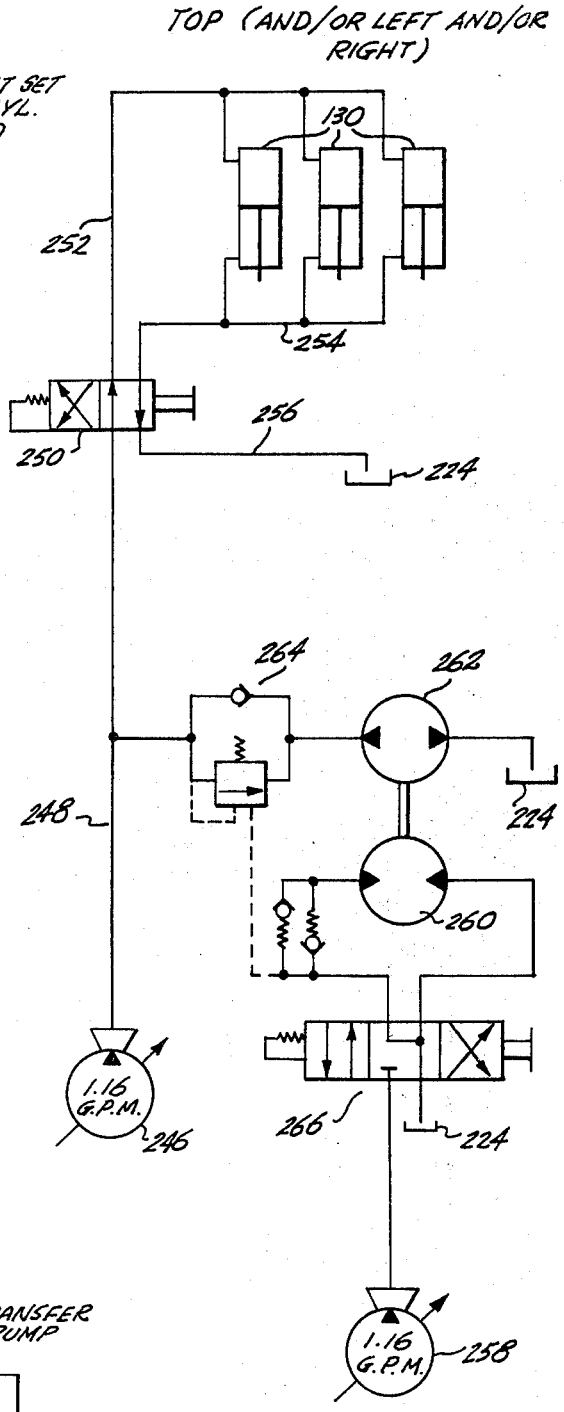
Fig. 14

DOUBLE SHIELD TUNNEL BORING MACHINE

CROSS REFERENCE TO RELATED APPLICATIONS

This is a continuation-in-part application of now abandoned application Ser. No. 802,878, abandoned filed June 2. 1977, which is in turn a continuation of now abandoned application Ser. No. 677,709, filed Apr. 16, 1976, abandoned which is a in turn continuation of now abandoned application Ser. No. 481,292, filed June 20, 1974 abandoned.

BACKGROUND OF THE INVENTION

1. Field of the Invention

This invention relates to tunnel boring machines, and more particular to the provision of a tunnel boring machine that is adapted to bore through a variety of geological materials, ranging from self-supporting ground to that requiring continuous lining support, and to a boring method.

2. Description of the Prior Art

A known form of machine designed for boring through geological material which is self-supporting is disclosed by U.S. Pat. No. 3,203,737, granted Aug. 31, 1965 to Richard J. Robbins, Douglas F. Winberg and John Galgoczy. This type of machine includes a gripper assembly comprising mechanism which is extendable laterally of the tunnel into anchoring engagement with both sidewall portions of the tunnel. Hydraulic cylinders extend forwardly from the gripper assembly to a frame which supports a power driven cutterhead. These cylinders react rearwardly against the gripper assembly and when they are extended serve to push the frame and the cutterhead carried thereby forwardly in the tunnel. At the end of the stroke the gripper assembly is retracted from the tunnel wall and is pulled forwardly by the cylinders into a new position. It is then extended laterally to take a new grip on the tunnel wall and the process is repeated.

It is also known to tunnel through ground which requires continuous lining support by means of a shield type tunneling machine. An example of a shield type tunneling machine is disclosed by U.S. Pat. No. 3,266,257, granted Aug. 16, 1966 to Raymond J. L. Larrouze, Pierre F. Gesta, Pierre J. M. Goussault, Douglas F. Winberg and Richard J. Robbins. This type of machine includes a tubular body or shield having a rearwardly extending tail section. A sectional tunnel lining is constructed generally behind the machine, within the cover afforded by the tail section. The shield is advanced forwardly during the tunneling operation by the use of a plurality of hydraulic cylinders which are extendable rearwardly from the shield to react against the forward portion of the tunnel lining.

U.S. Pat. No. 3,523,426, granted Aug. 11, 1970 to Ernest Lauber discloses a tunneling apparatus for forming a tunnel through rock having zones differing in stability. According to this patent the tunneling machine (a shield type machine) is used to excavate material. Then, the machine is retracted. Next, a ring of tunnel lining segments is installed in the tunnel forwardly of the machine. Then, the machine is advanced an additional amount. Next, the machine is retracted and another ring of tunnel lining segments is installed. This procedure is repeated until the machine has moved through a zone of soft or unstable material.

U.S. Pat. No. 3,411,826, granted Nov. 19, 1968, to Richard A. Wallers and John C. Haspert, also disclosed a tunnel boring machine which is adapted for boring through both self-supporting ground and ground that requires continuous lining support. It is basically a shield type machine and includes thrust rams which are extendable rearwardly to react against the tunnel lining for shoving the machine forwardly during tunneling through ground requiring a lining. However, the machine is also equipped with an accessory device in the form of a radially expandable ring. When the machine is used for boring through self-supporting ground the ring is installed in the tunnel behind the shield. It is expanded radially for the purpose of tightly gripping the tunnel wall, for the purpose of anchoring it in place in the tunnel. Then, the thrust cylinders are extended rearwardly to react against the anchored ring for moving the machine forwardly in the tunnel relative to such ring.

U.S. Pat. Nos. 3,613,379 and 3,613,384, granted on Oct. 19. 1971, to J. Donovan Jacobs, each discloses a multi-section shield type tunneling machine. The sections are telescopically joined and are each moved in the tunnel relative to the next by means of hydraulic thrust cylinders which may be interconnected between adjacent sections. Also, at least some of the sections are expandable radially to grip the tunnel wall, or carry radially extendable gripper shoes for gripping the tunnel wall. According to these patents, a continuous concrete lining is formed in the tunnel rearwardly of the machine.

An early form of shield tunneling machine is disclosed by U.S. Pat. No. 1,292,159, granted on Jan. 21, 1919, to F. J. Trumpour. It includes inner and outer shields which normally are advanced together by a set of thrust rams which react rearwardly against the forward end of the tunnel lining. When hard material is contacted, the outer shield is still moved forwardly by the thrust rams. The inner shield, which carries power operated cutter elements, is then moved forwardly at a different rate by additional thrust rams which react rearwardly against the outer shield.

SUMMARY OF THE INVENTION

The tunneling machine of the present invention is of the shield type. It comprises a pair of front and rear shields. The rear shield includes a gripper assembly which is extendable laterally against the tunnel wall for the purpose of tightly gripping the wall to in that manner anchor the rear shield against movement and react thrust and torque. A plurality of thrust rams are interconnected between the front and rear shields and are operable for shoving the front shield forwardly relative to the anchored rear shield, for pulling the rear shield forwardly after its grip on the tunnel wall has been released, and for steering the front shield relative to the rear shield. The rear shield also includes a rearwardly extending tail section under cover of which a sectional tunnel lining is constructed. Auxiliary thrust rams are carried by the rear shield. They are extendable rearwardly to contact and react against the forward end of the tunnel lining for reacting thrust and advancing the rear shield forwardly when the ground will not support the main gripper system.

The front shield is provided with a rotary cutterhead having cutter elements which dislodge material from the tunnel face. A pair of torque cylinders, or multiple pairs, serve to transfer counter-rotational torque from the front shield back to the anchored rear shield. These torque cylinders are adapted to change length and position as necessary during relative axial movement between the two shields. They are also operable for rotating each shield relative to the other, for roll correction of the machine.

Another aspect of the invention involves steering of the front shield relative to the rear shield by selective operation of the thrust rams between the shields.

These and other objects, features, advantages and characteristics of the present invention will be apparent from the following description of typical and therefore non-limitive embodiments thereof.

BRIEF DESCRIPTION OF THE DRAWING

In the drawing like letters and numerals refer to like parts, and:

FIG. 11 is a diagrammatic view of the steering arrangement for the embodiment shown by FIGS. 1–10;

FIG. 12 is a view like FIG. 11 but of a modified steering arrangement;

FIG. 13 is a view like FIGS. 11 and 12 but of still another form of steering arrangement;

FIG. 14 is a schematic view of a fluid supply and return for the upper set of forward thrust rams in the system of FIG. 12 and for each set of forward thrust rams in the system of FIG. 13;

DESCRIPTION OF THE PREFERRED EMBODIMENTS

Figure 1:
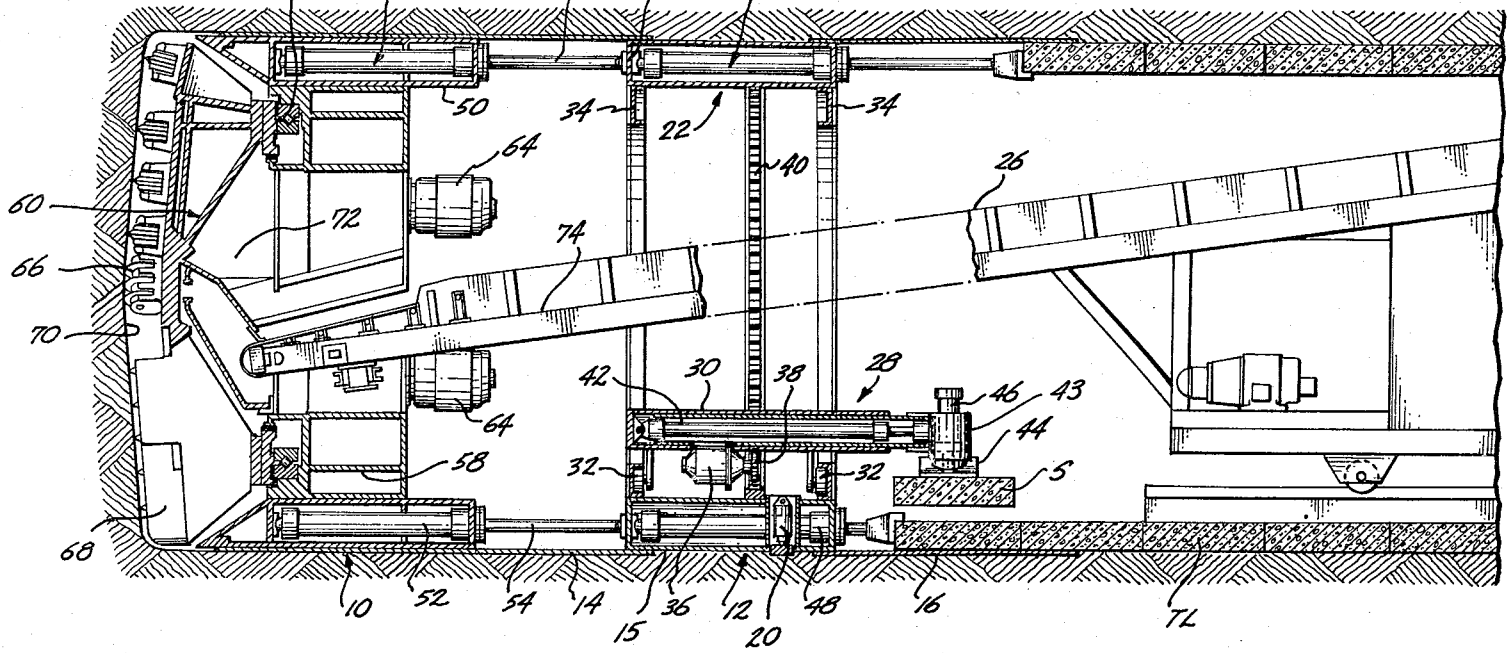
FIG. 1 is a longitudinal sectional view of an embodiment of the invention, with some parts in elevation.
Figure 2:
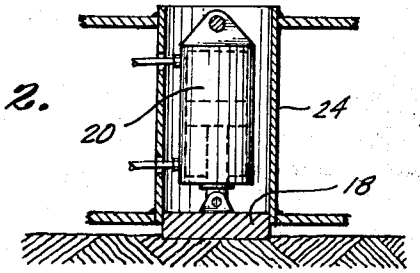
FIG. 2 is a fragmentary view on an enlarged scale of a gripper assembly for the rear shield of the tunneling machine shown by FIG. 1.
Figure 6:
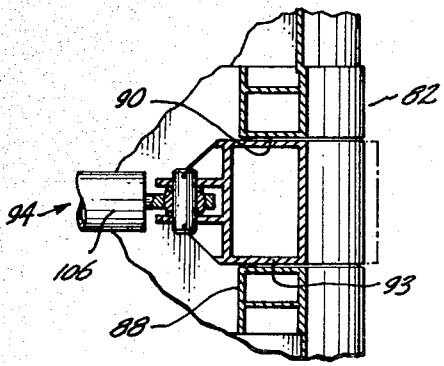
FIG. 6 is a fragmentary sectional view taken substantially along line 6—6 of FIG. 5.

Referring to FIGS. 1 and 2, the embodiment of the invention shown by these figures comprises a pair of telescopically joined tubular front and rear shields 10, 12. The front shield 10 is shown to comprise a rear section 14 which overlaps the forward portion 15 of rear shield 12. Rear shield 12 includes an elongated rearwardly extending tail section 16 within which a sectional tunnel lining TL is constructed.

The rear shield 12 also includes gripper means for gripping the side wall of the tunnel for the purposes of anchoring the rear shield 12 in place to react thrust and torque. The gripper means may comprise a plurality of radially extendable and retractable gripper shoes or pads 18 (FIG. 2) which are extended and retracted by double-acting hydraulic cylinders 20. The rear shield 12 further includes a ring-like, radially shallow frame 22 which is contiguous the shield wall or skin. This frame 22 includes generally radial guideways 24 for the gripper shoes 18. The central portion of the frame 22 is open to provide room for a conveyor 26 and a segment erector 28, and passage space for personnel.

The segment erector 28 includes a carriage 30 which is mounted by rollers 32 for movement around circular channel tracks 34 which are attached to the frame 22. The carriage 30 carries a drive motor 36 having a drive gear 38 which meshes with a large diameter internal gear 40 which is secured to frame 22. Carriage 30 also carries a double-acting hydraulic cylinder 42 which serves to move a head 43 back-and-forth axially of the tunnel. A shorter double-acting hydraulic cylinder 46 is provided on the head 43 for moving a segment grip 44 radially in-and-out.

Frame 22 also mounts a ring of axially disposed, rearly extendable thrust rams 48. The rams 48 are extendable rearwardly to react against the forward segments S of the tunnel lining TL. Following such extension, the rams 48 are retracted to provide space forwardly of the last completed ring of the tunnel lining segments S in which new segments S can be placed by the segment erector 28.

In the embodiment shown by FIGS. 1 and 2, the front shield 10 also comprises a ring-like open centered radially shallow frame 50. Frame 50 mounts a second ring of axially disposed, rearwardly extendable thrust rams 52. The piston rods 54 of thrust rams 52 are extendable rearwardly to react against a radial wall portion 56 of the frame 22. The rams 52 are double-acting hydraulic cylinders. Piston rods 54 are connected to the frame wall 56 so that they can also be used to pull shield 12 forwardly.

Front shield 10 also carries a cutterhead support 58. A power earth cutting means, e.g. a rotary cutterhead 60, is mounted on said cutterhead support 58 by a large diameter bearing 62. A plurality of drive motors 64, are mounted on the cutterhead support 58. They drive small diameter drive gears (not shown) which mesh with a large diameter gear (not shown) on the cutterhead 60, in the usual manner. The cutterhead 60 carries a plurality of forwardly directed cutter elements, such as rolling disc type cutters 66, for example. Material pickup buckets 68 are provided at the periphery of the cutterhead 60. These buckets serve to scoop up the material cut from the tunnel face 70 and deliver it into chutes in the cutterhead through which it flows into a hopper 72 positioned to discharge onto the conveyor belt 74 of conveyor 26. Conveyor belt 74 carries the mined material rearwardly out of the tunnel or to some other means of transporting them out of the tunnel. This operation occurs while the front shield is being shoved forwardly.

Each shield 10, 12 supports itself by virtue of the fact that its lower portion rests directly on the floor of the tunnel.

A tunnel lining may not be necessary when the machine is used to bore a tunnel through hard material which is capable of supporting itself. In such case the rear set of thrust rams 48 are retracted and not used. The gripper shoes 18 are extended to grip the tunnel wall to in that manner anchor the rear shield 12 in place in the tunnel. The forward thrust rams 52 are extended for the purpose of shoving the front shield 10 forwardly relative to the anchored rear shield 12. The cutterhead 60 is rotated to mine the tunnel face 70 as the shield 10 is being moved forwardly. Following full extension of the thrust rams 52 the gripper feet 18 are retracted and the thrust rams 52 are used for pulling the rear shield forwardly relative to the front shield 10. After the thrust rams 52 are fully retracted, and the rear shield 12 is in its new position forwardly of its old position, the gripper feet 18 are again extended and the above described operation is repeated.

When the tunneling machine is used for boring through material which is not sufficiently self-supporting a tunnel lining TL is erected in the wake of the machine, within the cover provided by the tail section 16 of the rear shield 12. In relatively firm material of this type the gripper feet 18 are extended for the purpose of anchoring the rear shield 12 in the tunnel. The thrust cylinders 52 are used for pushing the front shield 10 forwardly relative to the anchored rear shield 12 while the cutterhead 60 is driven for the purpose of mining the tunnel face 70. Following full advancement of the forward shield 10 the gripper feet 18 are retracted and the thrust cylinders 52 are used for pulling the rear shield 12 forwardly into a new position. The rear thrust rams 48 may have to be used to aid forward movement of shield 12. In other words, the rear thrust rams 48 may be extended rearwardly to react against the forward segments S of the tunnel lining TL. Following extension of the thrust rams 48 the gripper feet 18 are again extended for the purpose of anchoring the rear shield 12 in place in the tunnel. Then, the front shield 10 is again pushed forwardly relative to the rear shield 12 by use of the thrust rams 52. At the same time the thrust rams 48 may be retracted so that additional tunnel lining segments S can be set in place while the front shield advances for the purpose of forming a new ring of segments S at the forward end of the tunnel lining TL.

In ground that is not firm enough to permit use of the gripper feet, forward advancement of the shield 12 is achieved by use of thrust rams 48 alone. Also, the tunnel lining is erected while the machine is stopped, following extension of rams 48 to move shield 12 forwardly and then retraction of the rams 48 to provide spaces for receiving new segments of the lining.

Reference is now made to the embodiment shown by FIGS. 3–6. This embodiment also comprises a front or forward shield designated 80 and a rear shield designated 82. Both shields 80, 82 are tubular in form and in the illustrated embodiment are cylindrical. A rear portion of shield 80 telescopically receives a reduced diameter forward portion of shield 82. Rear shield 82 includes a ring-like, radially shallow inner frame 84. Like frame 22 of the embodiment of FIGS. 1 and 2, the frame 84 serves to mount a plurality of rearwardly extendable double-acting thrust rams cylinders 86 having piston rods 88 which react against the tunnel lining segments S. Frame 84 also includes a pair of generally radial guideways 90 for a pair of side positioned, diametrically opposed gripper shoes 92, 93. The shoes 92, 93 are extended and retracted by a pair of upper and lower double-acting hydraulic cylinders 94, 96. The upper cylinder 94 is interconnected between mounting ears 98, 100 at the upper ends of the gripper shoes 92, 93. In similar fashion, the lower fluid cylinder 96 is interconnected between mounting ears 102, 104 at the lower ends of the shoes 92, 93.

The sectional view (FIG. 5) of the lower motor 96 shows the internal make-up of both motors 94, 96. Each motor 94, 96 comprises a piston 106 having a piston head 108 which is received within a piston chamber 110 having a closed inward end 112 and a closed outward end 114. A first variable volume fluid chamber 116 is formed between piston head 108 and chamber wall 112. A first conduit 118 serves to both deliver fluid into and exhaust fluid out from the chamber 116. A second chamber 120 is formed between head 108 and chamber wall 114. A second conduit 122 is provided for both delivering fluid into and removing it from the chamber 120. The two cylinders 94, 96 are operated together. That is, when it is desired to extend the gripper shoes 92, 93 motive fluid is introduced into the chambers 116 of both cylinders 94, 96 and at the same time is exhausted from the chamber 120 of both cylinders 94, 96. The direction of fluid movement is reversed when it is desired to retract the gripper shoes 92, 93.

Figure 5:
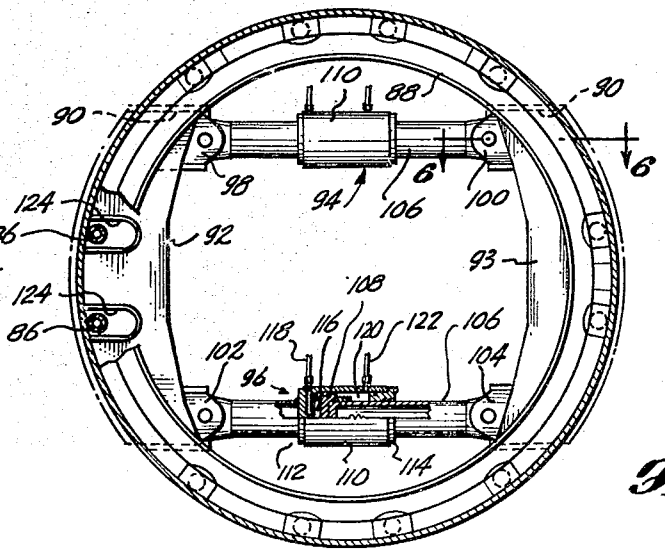
FIG. 5 is a cross-sectional view taken substantially along line 5—5 of FIG. 3, with some parts omitted.

As best shown by FIG. 5, the side located thrust rams 86 pass laterally through the guideways 90 for the gripper shoes 92, 93. In order to prevent interference with the gripper foot movement by the rams 86, slots 124 are provided in the gripper feet or shoes 92, 93. These slots 124 are elongated in a direction parallel with the direction of extent of the cylinders 94, 96. Such slots 124 are long enough to accommodate the amount of gripper shoe movement that is involved. In FIG. 5 the conveyor and other relatively central positioned components are omitted for the sake of clarity.

In this embodiment the forward shield 80 includes a tail section 124 which overlaps a reduced diameter forward section 128 of rear shield 82. As in the first embodiment, a second set of double-acting thrust rams or cylinders 130 are interconnected between a ring-like frame portion of front shield 80 and the ring-like frame 84 of rear shield 82. The cylinders 130 include piston rods 132 which are extendable rearwardly to react against the frame 84. The rear ends of the piston rods 132 are connected to the frame 84, so that the cylinders 130 can also be used for pulling the rear shield 82 forwardly relative to the front shield 82. A ball and socket joint or the like is provided at each end of each cylinder 130, between such end and its support structure.

Forward shield 80 mounts a cutterhead support 133 which in turn mounts one race of a large cutterhead bearing 134. The bearing 134 mounts a cutterhead 136 on the cutterhead support 133 for rotation about a center axis X. The cutterhead 136 carries forwardly direct cutter means for cutting the tunnel face 70 and means for picking up the cuttings and delivering them downwardly through chutes 138 which in turn deposits them onto the conveyor belt 140 of an endless belt conveyor 142. The cutterhead support 133 mounts a plurality of drive motors 144 which are arranged to drive the cutterhead 136 in a conventional manner.

The cutterhead 136 is slightly larger in diameter than the shields 80, 82. This is so that the cutterhead 136 will cut a circle that is slightly larger in diameter than the shields 80, 82. The lower boundary of the tunnel generally coincides with the lowermost surfaces of the shields 80, 82. Thus, a radial gap exists above the shields 80, 82 because of this difference in diameters. This radial space or gap is commonly termed an "overcut". The upper portion of the forward shield 80 carries a pair of stabilizer shoes 146 which move generally radially in-and-out through guideways 148 formed in a frame portion 150 of the shield 80. The shoes 146 are extended and retracted by double-acting hydraulic cylinders 151. One purpose of the shoes 146 is to provide a means which can be extended generally radially outwardly from the shield frame 150 to contact and slide along upper side portions of the tunnel, to provide stabilizing contact as needed at such locations.

The pads 146 may also be extended for the purpose of gripping the tunnel wall for the purpose of helping to anchor the forward shield 80 in place while the rear shield 82 is being advanced forwardly. In some installations it is believed that the weight of the forward shield 80 alone will be sufficient to anchor it in place while the rear shield 82 is being advanced. Of course, at times when the rear thrust rams 86 are being used for propelling the rear shield 82 forwardly, anchoring of the forward shield 80 is unnecessary.

Figure 3:
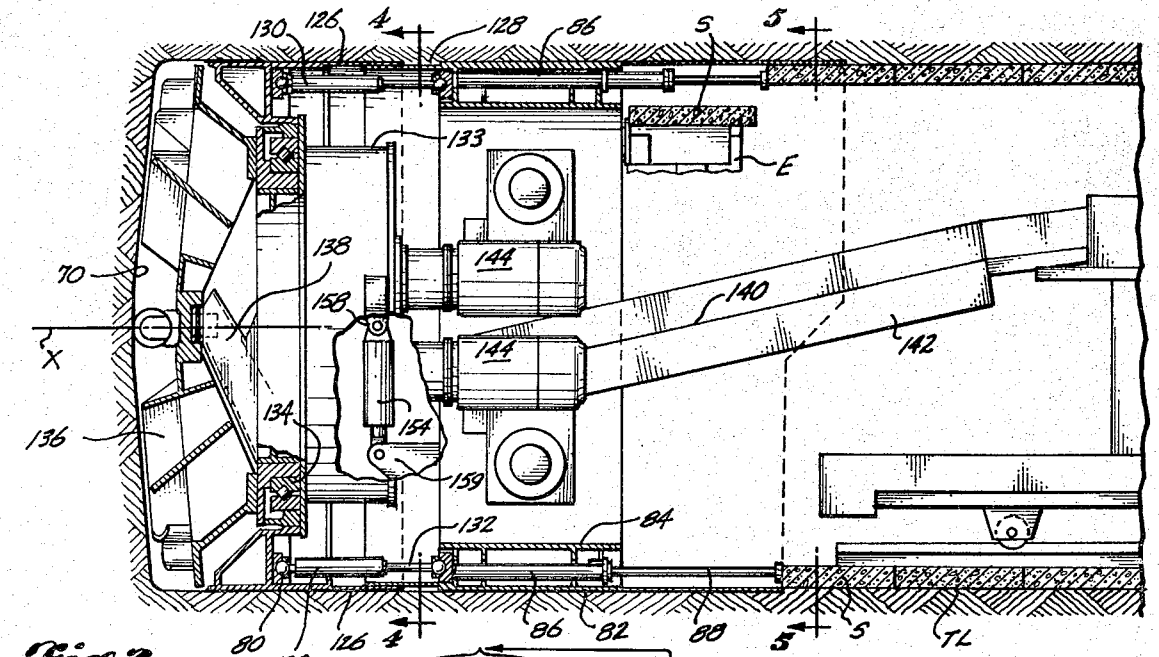
FIG. 3 is a view like FIG. 1, but of a second embodiment of the invention.

An aspect of the invention involves the provision of a pair of torque cylinders 151, 154 on opposite sides of the machine, to serve as structural links for transmitting torque between the two shields 80, 82. In FIG. 3 a foreground portion of cutterhead support 133 is cut away in order to show the position of torque cylinder 154. In the illustrated embodiment (FIGS. 3–9) the cutterhead support 133 is provided with rearwardly projecting mounting brackets 156, 158 at its two sides. The upper ends of the cylinders 152, 154 are pivotally connected to these brackets 156, 158 by a ball and socket joint or the like. The lower ends of the cylinders 152, 154 are similarly pivotally connected to brackets 157, 159 which are part of the rear shield 82.

Figure 7:
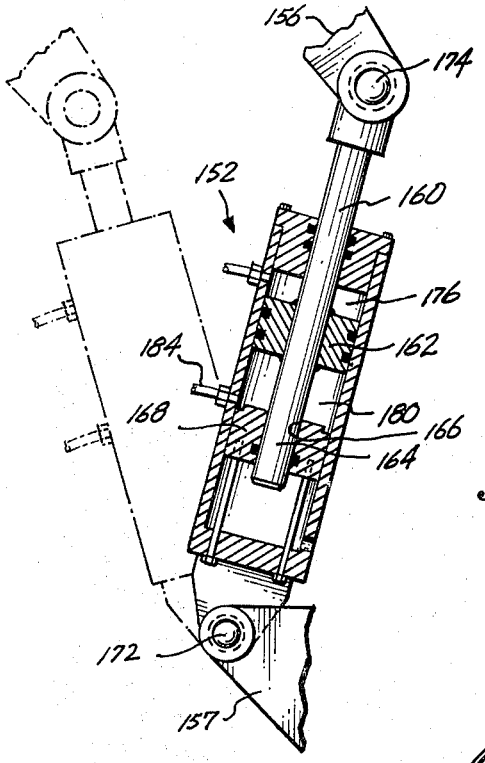
FIG. 7 is a fragmentary view, partially in section and partially in side elevation, of a torque cylinder.
Figure 9:
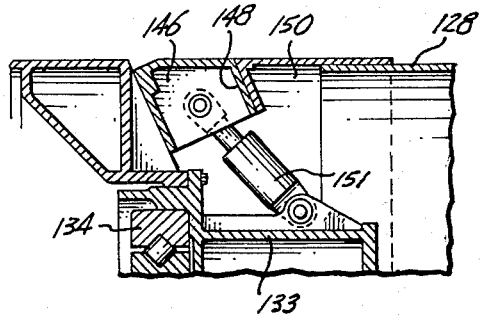
FIG. 9 is a fragmentary view of one of the upper stabilizer shoes on the front shield of FIGS. 1 and 3.

FIG. 7 shows the interior details of a typical embodiment of the torque cylinder 152, which will be used in conjunction with an identical torque cylinder 154. The cylinder 152 (154) is shown to comprise a piston rod 160 connected to a piston head 162. An extension 164 of the piston rod 160 extends from head 162 in the opposite direction of rod 160. It projects into a snugly fitting opening 166 formed in an end wall portion 168 of the cylinder 152. The lower end of the cylinder 152 is pivotally connected at 172 to the brackets 157 (159). The upper end of the piston rod 160 is pin connected at 174 to the bracket 156 (158). The piston rod extension 164 is provided so that equal areas exist on the two sides of the piston head 162.

Figure 8:
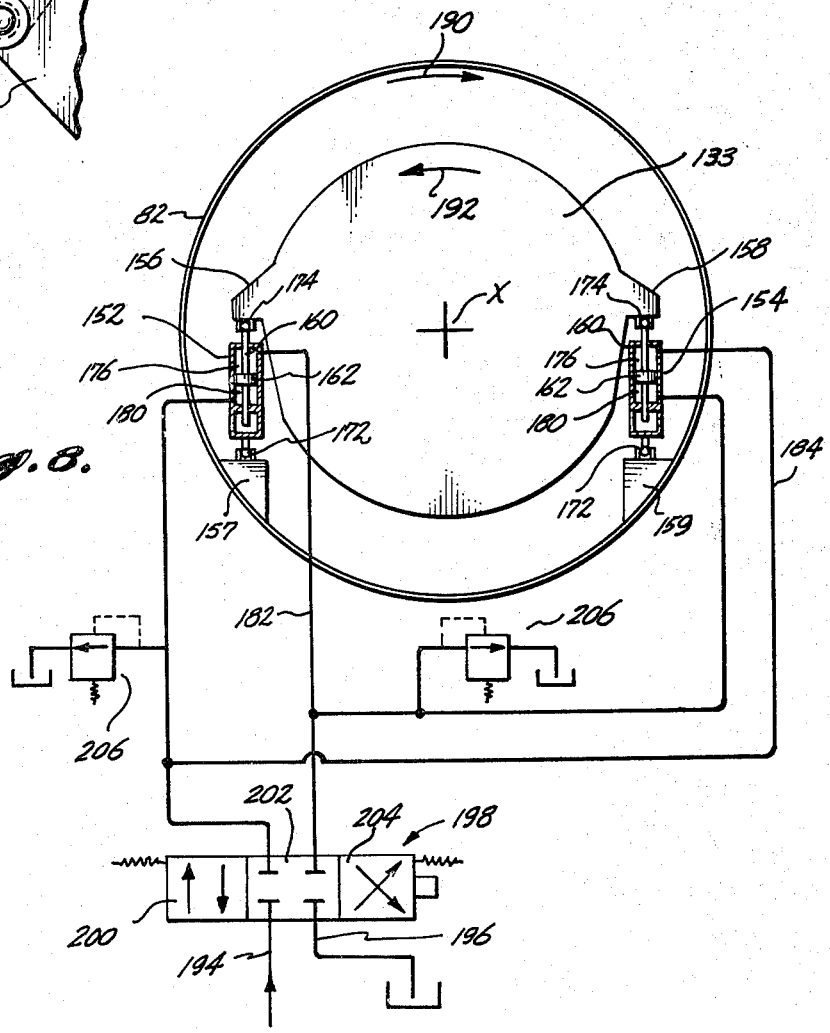
FIG. 8 is a schematic view of the fluid system for the torque cylinders.

According to the invention, and as shown in FIG. 8, the upper chamber 176 above piston head 162 of torque cylinder 152 is connected with the lower chamber 180 of the opposite side torque cylinder 154 by a fluid conduit 182. Also, the lower chamber 180 of torque cylinder 152 is connected with the upper chamber 176 of torque cylinder 154 by a fluid conduit 184.

When the two shields 80, 82 are telescopically shifted relative to each other, the two torque cylinders 152, 154 lean rearwardly from vertical, as shown by FIG. 7. As the forward shield 80 is pushed forwardly the upper connection point 174 moves axially forwardly. When the thrust rams 130 are fully extended the torque cylinders 152, 154 lean forwardly from vertical, as shown by broken lines in FIG. 7.

During drilling the cutterhead support 133 wants to rotate in the opposite direction from the cutterhead 136. This is because the torque applied to the cutterhead 136 for rotating it in the direction of the indicia arrow 190 is also imposed in the cutterhead support 133, tending to rotate it in the opposite direction, as indicated by the indicia arrow 192. During tunneling the rear shield 82 is anchored in place by virtue of the fact that the gripper feet 92, 93 are extended outwardly into gripping contact with the tunnel wall. The counter-rotational torque is transmitted by the torque cylinders 152, 154 from the cutterhead support 133 back into the rear shield 82 where actual rotation can be resisted by the gripping of the tunnel walls. The two torque cylinders work in conjunction. As can be seen by an inspection of FIG. 8, the counter-rotational torque tends to move piston rod 160, and piston head 162 of cylinder 152 downwardly, applying pressure on the fluid in chamber 180. The counter-rotational torque exerted on cutterhead support 133 also tends to lift piston rod 160 and piston head 162 of the torque cylinder 154, applying pressure on the fluid in chamber 176 of torque cylinder 154.

Owing to the provision of equal areas on opposite sides of the pistons 162, the torque cylinders 152, 154 can change length as necessary during telescopic movement of the shields 80, 82. Movement tending to shorten the cylinders 152, 154 results in an increase in volume of each chamber 176 and an equal change in volume in each chamber 180. Thus, during such movement fluid is merely transferred from each chamber 180 into the chamber 176 with which it is connected. In similar manner, movement tending to lengthen the cylinders 152, 154 causes a decrease in volume in the chambers 176 and corresponding equal increase in volume in the chambers 180. During such movement fluid is merely transferred from each chamber 176 over to the chamber 180 with which it is connected.

The counter-rotational torque may over a period of time cause some rotation in position of the shields 80, 82.

The fluid system for the torque cylinders 152, 154 includes supply and return lines 194, 196, and control valve means 198, operable so that fluid can be appropriately introduced into one pair of interconnected chambers 176, 180 and simultaneously exhausted from the other interconnected pair of chambers 176, 180 for the purpose of rotating one of the shields 80, 82 in position relative to the other. For example, shield 82 may be anchored in place by its gripper assembly and the torque cylinders 152, 154 used for rotating the front shield 80 back towards its proper position. Then, pads 146 may be extended to grip the tunnel wall and anchor the forward shield 80 in position while the torque cylinders 152, 154 are used to rotate the rear shield 82 (with gripper feet 92, 93 retracted) back towards its proper position.

As clearly shown by FIG. 8, valve 198 has three positions. A first position 200 is which fluid from supply line 194 is delivered into chamber 180 of cylinder 152 and into chamber 176 of cylinder 154, and the chambers 176 of cylinder 152 and 180 of cylinder 154 are connected to the exhaust line 196; a second position 202 in which both the supply line 194 and the exhaust line 196 are blocked (i.e., the normal torque transmitting position of the system); and a third position 204 in which the supply line 194 is connected to the chamber 180 of cylinder 154 and the chamber 176 of cylinder 152 and the exhaust line 196 is connected to chamber 180 of cylinder 152 and chamber 176 of cylinder 154. Each of the lines leading from the valve 198 to the cylinders 154, 152 include conventional relief valve 206, as illustrated.

Figure 4:
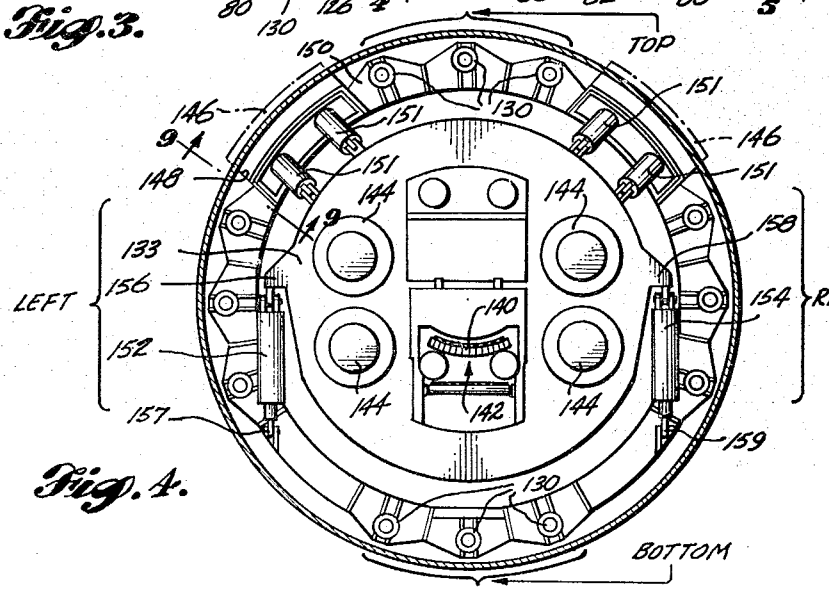
FIG. 4 is a cross-sectional view taken substantially along line 4—4 of FIG. 3.
Figure 10:
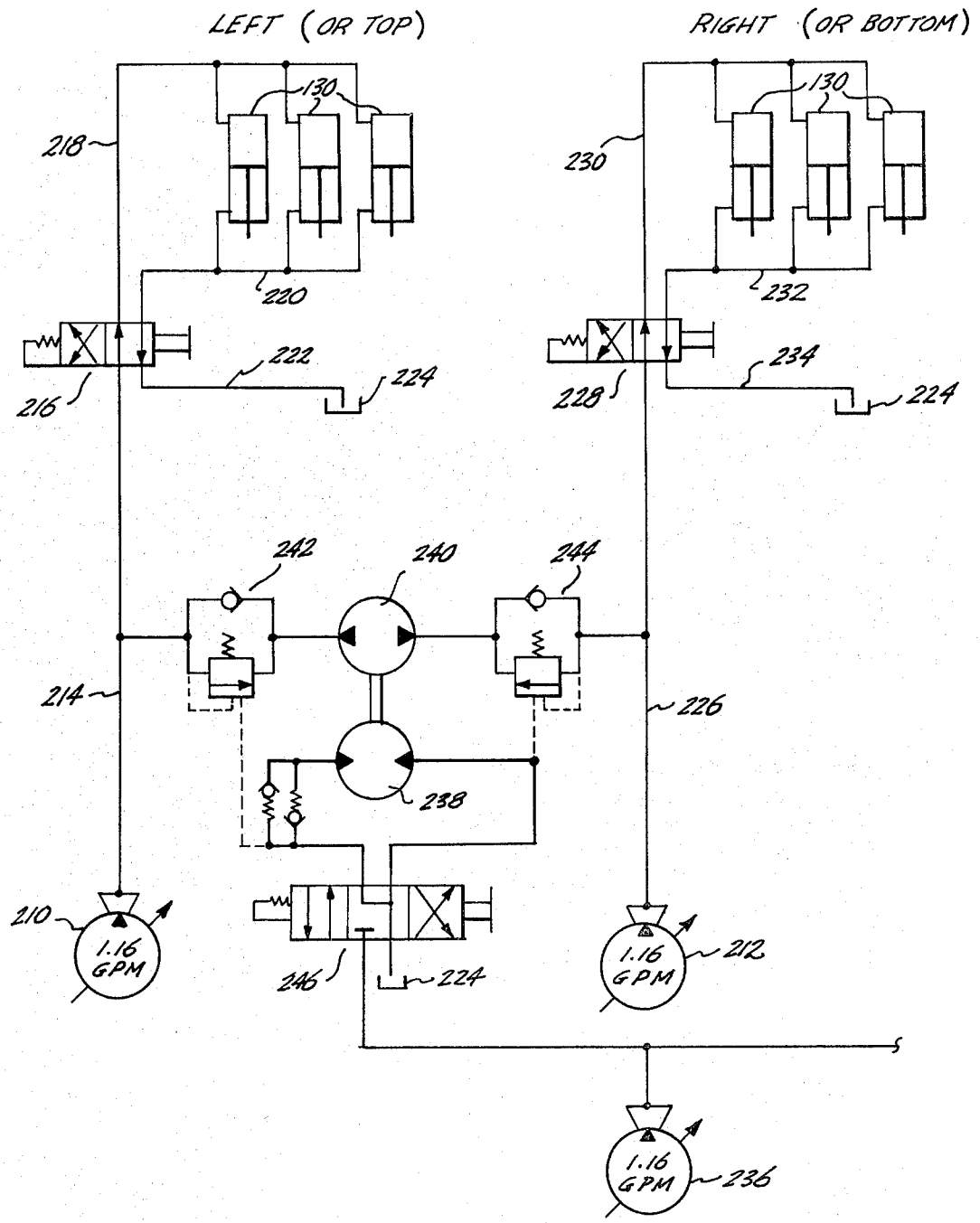
FIG. 10 is a schematic view of the fluid system for one diametrical opposite pair of forward thrust ram sets, the view also serving to illustrate the fluid system provided for the remaining pair of diametrically opposed thrust ram sets since the systems are essentially alike.

Referring to FIGS. 4 and 10, the upper set of three forward thrust rams 130 and the lower set of three forward thrust rams 130 are coordinated in a manner to be described below for the purpose of steering the front shield 80 vertically (i.e. control pitch) relative to the rear shield 82. Similarly, the left and right sets of forward thrust rams 130 are coordinate for the purpose of steering the front shield 80 right or left relative to the rear shield 82 (i.e. yaw control). A sufficient amount of clearance exists between the tail section 126 and the forward extension 128 to accommodate the amount of angular movement that is involved.

Referring to FIG. 10, a hydraulic pump 210 delivers hydraulic fluid to the set of three forward thrust rams 130 located on the left side of the machine. Another hydraulic pump 212 delivers hydraulic fluid to the three forward thrust rams 130 located on the right side of the machine. A delivery line 214 extnds from pump 210 to a control valve 216. The forward chambers of forward thrust rams 130 are interconnected and all three forward chambers are connected to the valve 216 by a line 218. The rear chambers of forward thrust rams 130 are also interconnected and are all three connected to valve 216 by a line 220. A return line 222 extends from valve 216 ultimate back to the fluid reservoir 224. In similar fashion, a delivery line 226 extends from pump 212 to valve 228. The forward chamber of the right side three thrust rams 130 are interconnected and by a line 230 are all three connected to the valve 228. The rear chambers of the right three thrust rams 130 are also connected together and are all three connected to valve 228 by a line 232. A return line 234 extends from valve 226 back to the reservoir 224.

Another pump 236 is provided for delivering fluid to a reversible hydraulic motor 238 which drives a reversible transfer pump 240. Transfer pump 240 is located between deliver lines 214, 226. Conventional holding valves 242, 244 are located between delivery lines 214 and pump 240 and between pump 240 and delivery line 226. A control valve 246 is located between pump 236 and motor 238.

During straight ahead travel of the tunneling machine, the pumps 210, 212 are operated for the purpose of delivering hydraulic fluid into the forward chambers of all of the thrust rams 130. The control valves 216, 228 are in the positions shown by FIG. 10. Hydraulic fluid in the rear chambers of the thrust rams 130 flows out from such chambers into the lines 220, 232, then through the valves 216, 228, then through lines 222, 234, and ultimately back to the reservoir 224. Following extension of the thrust rams 130, the control valves 216, 228 are operated to reverse the flow to and from the cylinders 130, so that the cylinders 130 will be retracted and the rear shield 82 will be pulled forwardly towards the front shield 80.

When it is desired to steer the machine sideways, such as to the right, for example, the valve 246 is operated to deliver flow from pump 236 to the hydraulic motor 238 so that such motor 238 will drive reversible pump 240 in the direction causing a transfer of fluid from delivery line 226 into 214. As a result, hydraulic fluid will be delivered into the forward chambers of the left side thrust rams 130 at a faster rate than it is delivered into the right side set of thrust rams 130. The left side rams 130 will be extended a greater amount than the right side cylinders 130 and the forward shield 80 will turn to the right.

The top three cylinders 130 are connected together in the manner illustrated and the bottom three cylinders are also connected together in the manner illustrated. During sideways turning of the machine fluid is delivered at substantially the same rate to both of these sets of cylinders 130. However, since the cylinders 130 of each set are interconnected the sideways turning movement of the front shield 80 results in an uneven distribution of fluid to both the upward three thrust cylinders 130 and the lower three thrust cylinders 130, so that these cylinders will not impede horizontal turning.

The front shield can be returned to a straight path, or can be moved to the left of a straight line path, by operation of valve 246 to reverse the direction of motor 238 and hence the direction of transfer of the motive fluid.

As previously mentioned, the fluid system for the top and bottom sets of thrust cylinders 130 are essentially like the illustrated system for the left and right side thrust cylinder 130. The top and bottom cylinders 130 are operated in the manner described for the purpose of steering the front shield 80 vertically upwardly or downwardly relative to the rear shield 82. During vertical steering there is uneven distributions of fluid to both the three left side cylinders 130 and the three right side cylinders 130, so that these cylinders will not impede vertical turning.

FIG. 11 diagrammatically illustrates the just described manner of steering, by dividing the main thrust rams 130 into four sets and then transferring some motive fluid between opposed sets.

FIG. 12 is a similar diagram of a modified arrangement of the main thrust rams. In this arrangement the main thrust rams are divided into three sets, e.g. a top set, a left set and a right set. Fluid is transferred between the two side sets of cylinders for steering the machine sideways. It is transferred between the upper set and the reservoir for steering the machine vertically.

FIG. 13 is a diagrammatic view of a further arrangement of the main thrust cylinders. According to this arrangement, a transfer pump assembly is provided between each set of cylinders and the reservoir.

FIG. 14 is a schematic view of a typical transfer system of the type which may be associated with the top set of cylinders in the arrangement shown in FIG. 12, and with each set of cylinders in the arrangement shown by FIG. 13. It will be noticed, this system is basically like the transfer system shown by FIG. 10, except that the transfer is made between the delivery line for the thrust cylinders and the reservoir 224. Specifically, the hydraulic pump 246 delivers hydraulic fluid to the set of forward or main thrust rams 130. A delivery line 248 extends from pump 246 to a control valve 250. The forward chambers of forward thrust rams 130 are interconnected and all three forwards chambers are connected to the valve 250 by a line 252. The rear chambers of forward thrust rams 130 are also interconnected and are all three connected to valve 250 by a line 254. A return line 256 extends from valve 250 ultimately back to the fluid reservoir 224.

Another pump 258 is provided for delivering fluid to a reversible hydraulic motor 260 which drives a reversible transfer pump 262. Transfer pump 262 is located between the delivery line 248 and the reservoir 224. A conventional holding valve 264 is located between delivery line 248 and pump 262. A control valve 266 is located between pump 258 and motor 260.

Let it be assumed that the system shown in FIG. 14 is connected with the top set of cylinders in the arrangement of FIG. 12. Also let it be assumed that the system shown by FIG. 10 is connected to the left and right set of cylinders. During straight ahead travel of the tunneling machine, the pumps 210, 212, 246 are operated for the purpose of delivering hydraulic fluid into the forward chambers of all of the thrust rams 130. The control valves 216, 228, 250 are in the positions shown by FIGS. 10 and 14. Hydraulic fluid in the rear chambers of the thrust rams 130 flows out from such chambers into the lines 220, 232, 254, then through the valves 216, 228, 250, then through line 222, 234, 256, and ultimately back to the reservoir 224. Following extension of the thrust rams 130, the control valves 216, 228, 250 are operated to reverse the flow to and from the cylinders 130, so that the cylinders 130 will be retracted and the rear shield 82 will be pulled forwardly towards the front shield 80.

When it is desired to steer the machine sideways, such as to the right, for example, the sequence of operation that has already been described in connection with FIG. 10 is followed. When it is desired to steer the front shield vertically upwardly or downwardly relative to the rear shield 82, the control valve 266 (FIG. 14) is operated to control the direction of rotation of motor 260, and hence pump 262, for the purpose of either pumping some of the fluid from delivery line 248 into the reservoir 224, or fluid from the reservoir 224 into the delivery line 248.

As will be apparent, in a system of the type shown by FIG. 13, the transfer pump control valves 266 are used for selectively adding or withdrawing fluid from one or more of the sets of forward thrust cylinders, to in that manner change the direction of travel of the front shield relative to the rear shield.

Figure 15:
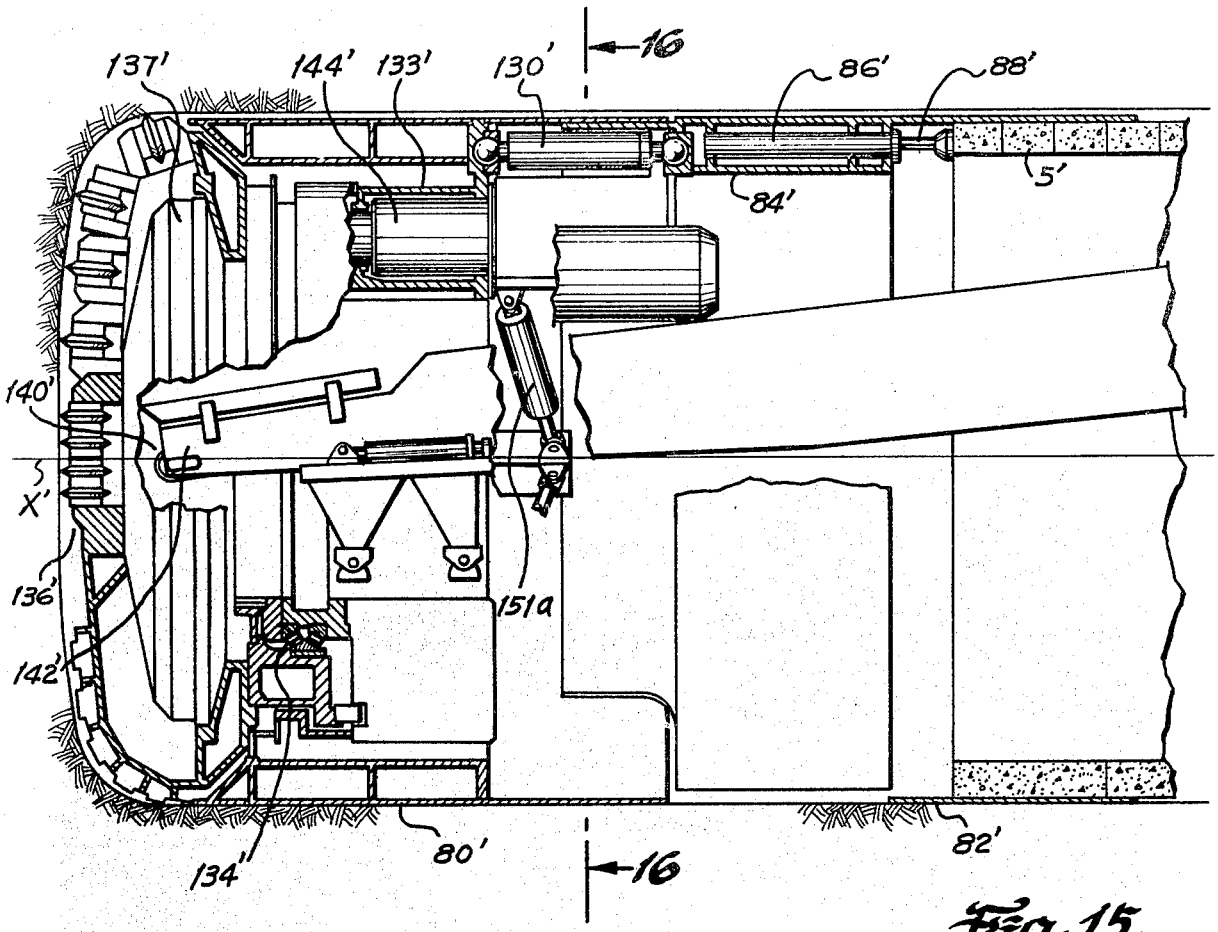
FIG. 15 is a view similar to FIGS. 1 and 2, but of an alternative embodiment of the present invention.
Figure 16:
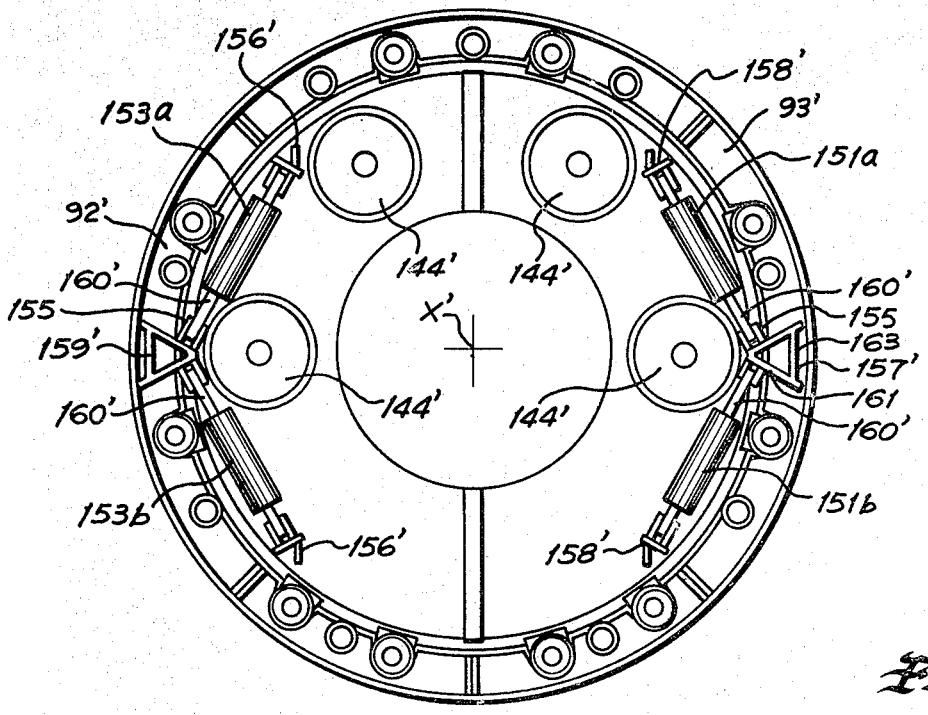
FIG. 16 is a cross-sectional view of FIG. 15 taken substantially along line 16—16 thereof with some components removed for clarity.
Figure 17:
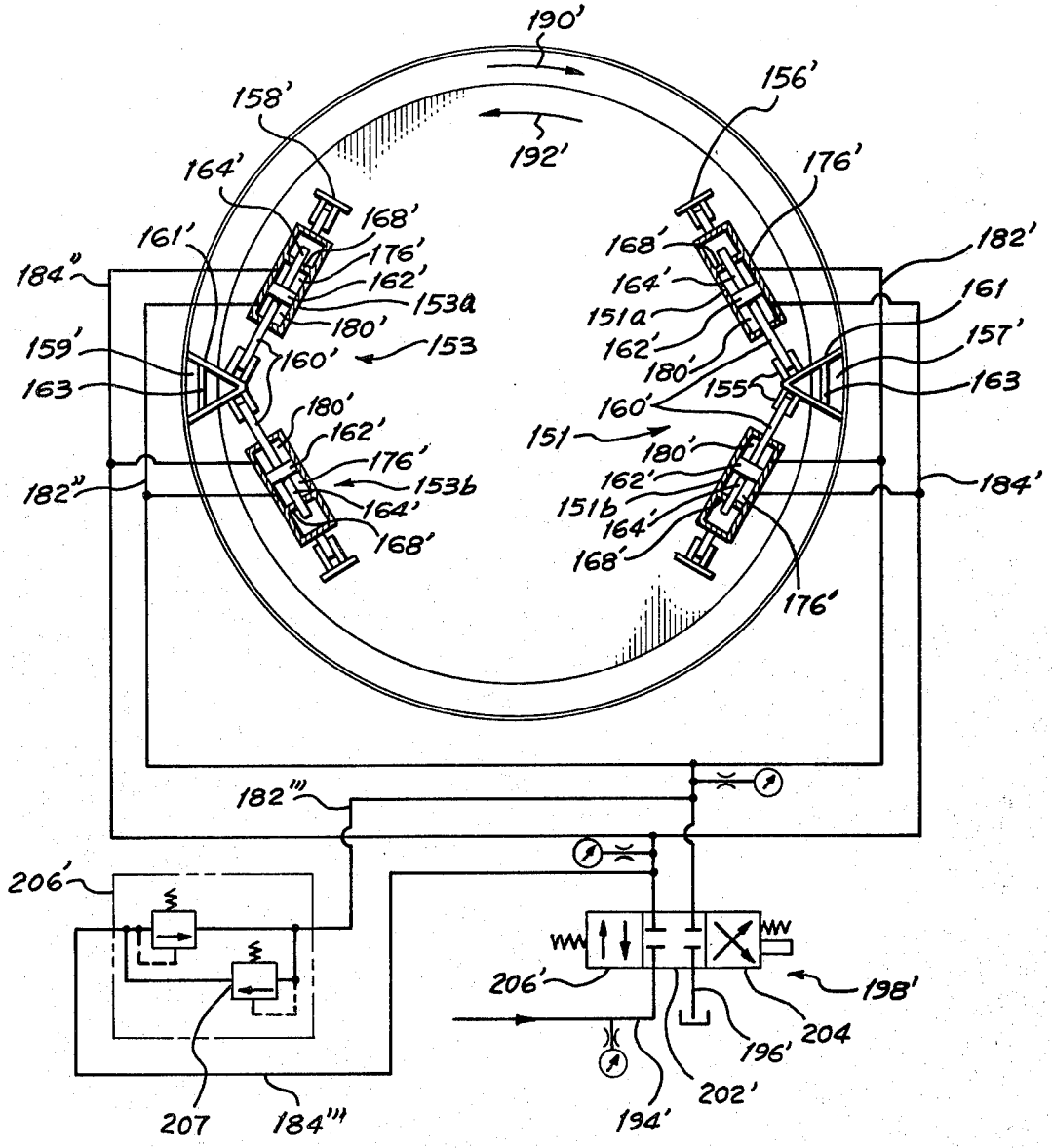
FIG. 17 is a schematic view of the fluid system for the torque cylinders.

An alternative embodiment of a tunneling machine is illustrated in FIGS. 15–17. Except for the differences discussed below, the tunneling machine illustrated in these figures is constructed in a manner similar to the tunneling machines illustrated in FIGS. 1–14.

The tunneling machine includes a front or forward shield 80' and a rear shield 82' interconnected by double-acting thrust rams 130'. Both shields 80', 82', are tubular in form and in the illustrated embodiment are cylindrical. As in the tunneling machine illustrated in FIGS. 1–6, a rear portion of shield 80' telescopically receives a reduced diameter forward portion of rear shield 82'. Rear shield 82' includes a ring-like, inner frame 84' defining a substantially open center opening in a manner similar to frame 22 illustrated in FIGS. 1 and 2 and frame 84 illustrated in FIGS. 3–6. Inner frame 84' serves to mount a plurality of rearwardly extendible double-acting thrust rams or cylinders 86', with piston rods 88' of the cylinders extendable to react against tunnel lining segments S'. Frame 84' also includes guideways (not shown) for gripper shoes 92', 93', which are extendable and retractable for gripping the side wall of the tunnel to anchor rear shield 82' in place to react against thrust and torque loads imposed by cutterhead 136' and forward shield 80' during tunneling operations. Gripper shoes 92', 93' are guided and powered in a manner similar to the manner in which the gripper shoes 92, 93, illustrated in FIGS. 3–6 are guided and powered.

A cutterhead support structure 133' is mounted on forward shield 80' and a cutterhead 136' is in turn mounted on the support structure through the intermediacy of bearings 134'. The cutterhead carries forwardly directed roller cutters for excavating the tunnel face. The cutterhead includes scoop buckets 137' located rearwardly of the roller cutters for picking up the cuttings and depositing them on conveyor belt 140' on the forward end of endless belt conveyor 142' which extends through the central open portion of cutterhead support structure 133'. A plurality of drive motors 144' are mounted on cutterhead support structure 133' for driving cutterhead 136'. In the particular embodiment of the present invention illustrated in FIG. 16, two drive motors 144' are elevationally located at approximately the rotational axis X' of the cutterhead. Two additional drive motors 144' are positioned at the upper portions of cutterhead support structure 133'. By placing the drive motors at these locations, in most situations they are kept above the level of the debris and muck which tend to collect in the lower portions of the tunneling machine.

In a manner similar to the embodiments of the present invention illustrated in FIGS. 1–14, a plurality of pairs of torque cylinders are utilized to transmit torque between the two shields 80' and 82'. As illustrated in FIGS. 15–17, one pair 151 of torque cylinders **151*a* and 151*b* is located on one side of the tunneling machine while another pair 153 of torque cylinders 153*a* and 153*b* is located on the opposite side of the tunneling machine. The cylinders 151*a*, 151*b*, 153*a* and 153*b* are disposed generally tangentially and at the peripheral portions of the shields 80' and 81'. Mounting brackets 156' and 158' are fixed to the peripheral portions of cutterhead support section 133' to receive the cylinder end portions of cylinder pairs 151 and 153. Ball and socket joints or the like are used to interconnect the cylinder end portions of the cylinders to the brackets. The rod end portions of the cylinders are similarly pivotally connected to corresponding mounting ears 155 of brackets 157', 159' which in turn are secured to inner frame 84' of rear shield 82' at an elevation corresponding to the centers of lower drive motors 144'. Brackets 157', 159', in the illustrated form, each includes a generally V-shaped anchoring section 161 to which mounting ears 155 are secured and a vertical cross brace 163** spanning across the two halves of the V-section.

Each torque cylinder, as schematically illustrated in FIG. 17, is constructed similarly to torque cylinder 152 illustrated in FIG. 7 and discussed above. Each torque cylinder includes a piston rod 160' connected to a piston head 162' which defines a first chamber 176' on the side of the piston head opposite the rod and a second chamber 180' on the side of the piston head adjacent the rod. An extension 164' of the piston rod 160' extends from head 162' in the direction oppositely of the rod to slidably engage through a close fitting opening formed on an end wall portion 168' of each of the cylinders. By virtue of piston rod extensions 164', equal areas exist on the opposite sides of piston head 162'.

Referring specifically to FIG. 17, the first chamber 176' of torque cylinder **151*a* is connected with the second chamber 180' of corresponding torque cylinder 151*b* by fluid conduit 182', and the second chamber 180' of cylinder 151*a* is connected with the first chamber 176' of cylinder 151*b* by fluid conduit 184'. Likewise, first chamber 176' of torque cylinder 153*a* is connected to second chamber 180' of torque cylinder 153*b* by fluid conduit 184'', and second chamber 180' of torque cylinder 153*a* is connected to first chamber 176' of torque cylinder 153*b* by a fluid conduit 182''**.

During tunneling operations when cutterhead 136' is rotated in the direction of indicia arrow 190' by drive motors 144', cutterhead support structure 133' tends to rotate in the opposite direction as indicated by indicia arrow 192'. During tunneling operations, rear shield 82' is anchored in place by gripper shoes 92', 93' which are extended outwardly into gripping contact with the tunnel wall. The counter-rotational torque imposed on cutterhead support 133' by cutterhead 136' is transferred by torque cylinders 151*a*, 151*b*, 153*a*, 153*b*, from the cutterhead support back to rear shield 82' and gripper shoes 92' and 93' where actual rotation of support 133' and shields 80' and 82' is resisted by the gripping of the tunnel walls. In transferring the counter-rotational torque from cutterhead support 133' to rear shield 82', the two torque cylinders work in concert to function as a fluid couple.

The counter-rotational torque tends to force piston 162' of cylinder 151*a* towards second chamber 180' thereby applying pressure to the fluid located therein and simultaneously tends to move piston 162' of cylinder 151*b* toward first chamber 176' thereby applying pressure to the fluid located therein. Since second chamber 180' of cylinder 151*a* is connected in fluid flow communication with first chamber 176' of cylinder 151*b*, these two cylinders effectively transfer the counter-rotational torque loads from cutterhead support structure 133' to rear shield 82'. The counter-rotational torque also tends to move the piston of cylinder 153*a* towards first chamber 176' thereby pressurizing the fluid located therein, and simultaneously tends to shift the piston of cylinder 153*b* towards chamber 180' thereby pressurizing the fluid located therein. Because the first chamber 176' of cylinder 153*a* is connected in fluid flow communication with second chamber 180' of cylinder 153*b*, cylinders 153*a* and 153*b* are also capable of transferring the counter-rotational torque load imposed on cutterhead support 133' to rear shield 82'.

In a manner similar to the operation of torque cylinders 52, 54, as discussed above, when the two shields 80', 82' telescopically shift relative to each other, torque cylinders 151*a*, 151*b*, 153*a* and 153*b* can change in lengthto accommodate this telescopic movement. Movement tending to shorten the cylinders results in an increase in volume in each chamber 180' and a corresponding decrease in volume in each chamber 176. Thus, during such movement, fluid is merely transferred from each chamber 176' to the chamber 180' with which it is connected. In a similar manner, movement tending to lengthen the cylinders causes a decrease in volume in the chamber 180' and a corresponding equal increase in volume in the chambers 176'. During such movement, fluid is transferred from each chamber 180' to the chamber 176' with which it is connected.

Torque cylinders 151*a*, 151*b*, 153*a* and 154*b* may be utilized to rotate shields 80' and 82' relative to each other, for instance to angularly realign the shields to correct for leakage of fluid past cylinder pistons 162'. For example, rear shield 82' may be anchored in place by gripper shoes 92' and 93' and the torque cylinders used to rotate the front shield 80' back to its proper position. To rotate front shield 90', for instance in the clockwise direction as illustrated in FIG. 17, a control valve 198' is shifted from its blocked position 202' (the normal torque transmitting position of the system) to position tool 204' thereby supplying fluid from a supply line 194' to lines 182' and 182'', which lines transmit the fluid to chambers 176' and 180' of cylinders 151*a*, and 151*b*, respectively, and chambers 180' and 176' of cylinders 153*a* and 153*b*, respectively. Simultaneously, fluid within chamber 180' of cylinder 151*a*, chamber 176' of cylinder 151*b*, chamber 176' of cylinder 153*a*, and chamber 180' of cylinder 153*b* is exhausted through corresponding lines 184' and 184'', valve 198' and outlet line 196'. Alternatively, to rotate forward shield 80' in the counterclockwise direction, valve 198' is shifted to position 200' so that fluid is transferred to and from the torque cylinders in a manner opposite in which fluid is transferred to and from the cylinders when the forward shield is rotated in the clockwise direction.

It will be appreciated that locating cylinders 151*a*, 151*b*, 153*a*, and 153*b* in the positions described above and illustrated in FIGS. 15–17 enables the cylinders not only to advantageously function in the manner specified above, but also permits the drive motors 144' to be located in the upper portions of the front and rear shields. If the drive motors are located in positions other than those illustrated in FIGS. 15–17, the torque cylinders may be repositioned to provide clearance for the drive motors and/or a fewer or greater number of pairs of cylinders may be utilized. Moreover, the number of pairs of cylinders also may be varied to accommodate the level of counter-rotational torque loads imposed on cutterhead support structure 133' by cutterhead 136' or the force needed to rotate the front and rear shields relative to each other.

Fluid conduits 182', 182'', 184', and 184'' are interconnected with a cross-over release valve 206' by lines 182''' and 184''', which release valve limits the maximum pressure imposed across pistons 162' of the torque cylinders. For instance, if cutterhead 136' suddenly encounters very hard rock material so that a high pressure spike is created in chamber 176' of cylinder 151*a*, chamber 180' of cylinder 151*b*, chamber 180' of cylinder 153*a* and chamber 176' of cylinder 153*b*, spool 207 of valve 206' is shifted into fluid passing position to thereby allow the highly pressurized fluid in line 182''' to be transmitted to line 184''' which in turn transmits the pressure spike through conduits 184' and 184'' to the opposite chambers of each of the torque cylinders to thereby null out the pressure spike.

As will be apparent to those skilled in the art to which the invention is addressed, the present invention may be embodied in forms other than those specifically disclosed above without departing from the spirit or essential characteristics of the invention. The particular embodiments of the tunnel boring machines, as described above, are therefore to be considered in all respects illustrative and not restrictive with the scope of the present invention being set forth in the appended claims rather than being limited to the foregoing description.

What is claimed is:

1. A tunneling machine comprising:

front and rear ground supporting tubular shields, each having a ground contacting outer surface, with at least a substantial portion of the front shield always being positioned forwardly of said rear shield, and with at least a substantial portion of the rear shield always being positioned rearwardly of said front shield;

radially expandible-contractable gripper means on said rear shield, operable for gripping the tunnel wall to in that manner anchor the rear shield against at least axial movement relative to the tunnel wall;

said rear shield having a tail section comprising tubular wall means which extend axially rearwardly from said gripper means, and providing a space under cover of said tubular wall means within which a tunnel lining is constructed;

thrust ram means comprising a first ring of axially extending linear hydraulic motors interconnected between the front and rear shields, adjacent the peripheries thereof, means for selectively delivering hydraulic fluid into said thrust ram means so that said thrust ram means are operable for shoving the front shield axially forwardly relative to the rear shield while the rear shield is anchored in position by the gripper means, and for turning said front shield in the tunnel relative to the rear shield to in this manner change the direction of advance of the tunneling machine;

a second ring of axially extending linear hydraulic motors each having piston and cylinder portions, a first one of said portions being mounted on said rear shield and the second one of said portions being extendible rearwardly from said first portion and the rear shield to contact and push against a tunnel lining within the tail section space;

power earth cutting means on said front shield, for cutting material from the tunnel face during forward movement of the front shield; and power conveyor means extending from said power earth cutter means rearwardly through said front and rear shield, for removing cuttings from the tunnel face.

2. The tunneling machine of claim 1, wherein said rear shield comprises a tubular skin and a ring-like inner frame contiguous with said skin to which the rear end portions of said linear hydraulic motors are connected, wherein said frame includes radial gripper shoe guideways, and wherein said gripper means comprises generally radially movable gripper shoes within said guideways, and fluid motors for extending and retracting said gripper shoes.

3. A tunneling machine comprising:

front and rear ground supporting tubular shields, each having a ground contacting outer surface, with at least a substantial portion of the front shield always being positioned forwardly of said rear shield, and with at least a substantial portion of the rear shield always being positioned rearwardly of said front shield;

radially expandible-contractable gripper means on said rear shield, operable for gripping the tunnel wall to in that manner anchor the rear shield against at least axial movement relative to the tunnel wall;

said rear shield having a tail section comprising tubular wall means which extend axially rearwardly from said gripper means, and providing a space under cover of said tubular wall means within which a tunnel lining is constructed;

thrust ram means comprising a ring of axially extending linear hydraulic motors interconnected between the front and rear shields, adjacent the peripheries thereof, means for selectively delivering hydraulic fluid into said thrust ram means so that said thrust ram means are operable for shoving the front shield axially forwardly relative to the rear shield while the rear shield is anchored in position by the gripper means, and for turning said front shield in the tunnel relative to the rear shield to in this manner change the direction of advance of the tunneling machine;

power earth cutting means on said front shield, for cutting material from the tunnel face during forward movement of the front shield;

power conveyor means extending from said power earth cutter means rearwardly through said front and rear shields, for removing cuttings from the tunnel face; and a plurality of linear fluid motors interconnected between the front and rear shields, said motors being oriented so that their lines of force extend generally tangentially to the shields, and pivotal connection means at each end of each motor, connecting it to its shield, said motors serving to resist rotation of the front shield relative to the rear shield while the rear shield is restrained against movement by the gripper means, the forward shield is being moved foward by the thrust ram means, and the power earth cutting means is being employed for cutting material from the tunnel face, with said pivotal connection means permitting said motors to rotate in position as necessary during relative axial and turning movement between the two shields.

4. The tunneling machine of claim 3, wherein said linear fluid motors are positioned generally along the periphery of the front and rear shields.

5. The tunneling machine of claim 2, wherein:

the inner frame includes a pair of opposed radial gripper shoe guideways;

the gripper means comprises a pair of generally radially movable gripper shoes within said guideways, and a pair of parallel fluid motors for extending and contracting said gripper shoes, said pair of parallel fluid motors being interconnected between the corresponding ends of the two gripper shoes, with an open space existing between said fluid motors; and the power conveyor means extends through the space between the two gripper shoe operating fluid motors.

6. The tunneling machine of claim 5, further including a second ring of axially extending, linear hydraulic motors mounted on said frame and extendible rearwardly to contact and react against the tunnel lining, said second ring of linear hydraulic motors being spaced about the rear portion of the rear shield, and including linear hydraulic motors which intersect the said radial gripper shoe guideways, and wherein said gripper shoes include an opening for receiving and accommodating each such linear hydraulic motor.

7. A tunneling machine comprising:

front and rear tubular ground supporting shields each having a ground contacting outer surface, with at least a substantial portion of the front shield always being positioned forwardly of said rear shield, and with at least a substantial portion of the rear shield always being positioned rearwardly of said front shield;

gripper means on said rear shield, for gripping the tunnel wall to anchor the rear shield against movement;

thrust ram means interconnected between the front and rear shields, for shoving the front shield forwardly relative to the rear shield while the rear shield is anchored in position by the gripper means;

rotary power driven earth cutting means on said front shield, for cutting material from the tunnel face during forward movement of the shield front portion, including means carried by the front shield for rotatably driving the cutterhead means, whereby counter-rotational torque is transferred to the front shield; and a plurality of torque cylinders interconnected between the front and rear shields, said cylinders:

being disposed generally tangentially of said shields, and including pivotal connection means at each end of each torque cylinder for connection of the torque cylinders to the shields, with said pivotal connection means permitting said torque cylinders to rotate in position as necessary during relative axial and turning movement between the two shields.

8. A tunneling machine according to claim 7, wherein said torque cylinders are located generally along the periphery of the front and rear shields.

9. A tunneling machine according to claim 7:

wherein each torque cylinder comprises a cylindrical body connected to one of said front and rear shields and a piston connected to the other, said piston including a piston head inside of said body, with a first fluid chamber being formed on one side of the piston head and a second fluid chamber being formed on the opposite side of the piston head, and with said piston head presenting equal area faces towards each chamber, and further comprising conduit means connecting the first chamber of each torque cylinder with the second chamber of another torque cylinder.

10. A tunneling machine according to claim 9, further comprising selectively operable means for delivering a fluid under pressure into one or the other connected together pair of chambers and simultaneously exhausting fluid from the second pair of connected together chambers.

11. A tunneling machine comprising:

front and rear tubular ground supporting shields each having a ground contacting outer surface, with at least a substantial portion of the front shield always being positioned forwardly of said rear shield, and with at least a substantial portion of the rear shield always being positioned rearwardly of said front shield;

gripper means on said rear shield for gripping the tunnel wall to in that manner anchor the rear shield against movement relative to the tunnel wall;

thrust ram means interconnected between the front and rear shields for both shoving the front shield forwardly relative to the rear shield and turning said front shield in the tunnel relative to the rear shield to in this manner change the direction of advance of the tunneling machine, said thrust ram means comprising a ring of fluid cylinders circumferentially divided into at least three distinct sets;

means for delivering fluid to all of said sets of cylinders for operating them all to shove the front shield forwardly relative to the rear shield;

means associated with each set of said cylinders for selectively increasing or decreasing the amount of fluid that is delivered to each set for steering the front shield relative to the rear shield; and at least one pair of torque cylinders interconnected between the front and rear shields and disposed generally tangentially to the front and rear shields.

12. The tunneling machine according to claim 11, wherein said torque cylinders are located closely adjacent the periphery of the front and rear shields.

13. A tunneling machine according to claim 11, further comprising selectively operable means for delivering fluid under pressure into one or the other connected together pair of chambers and simultaneously exhausting fluid from the second pair of connected together chambers.

14. A tunneling machine comprising:

telescopically joined front and rear ground supporting tubular shields each having a ground contacting outer surface, said outer surfaces being substantially identical in cross-sectional configuration, with at least a substantial portion of the front shield always being positioned forwardly of said rear shield and at least a substantial portion of the rear shield always being positioned rearwardly of said front shield;

radially expandible-contractible gripper means on said rear shield for gripping the tunnel wall to anchor the rear shield against both axial and angular movement relative to the tunnel wall;

a tail section on said rear shield which extends rearwardly from said gripper means for providing a space under cover of said rear shield within which a tunnel lining is constructed;

forward thrust ram means interconnected between the front and rear shields for shoving the front shield forwardly relative to the rear shield and/or turning said front shield in the tunnel relative to the rear shield while the rear shield is anchored in position by the gripper means to in this manner change the direction of advance of the tunneling means, said forward thrust ram means comprising at least three sets of linear actuator means disposed about the periphery of the front and rear shields;

means for selectively actuating the sets of linear actuator means at varying rates to coordinate the linear actuator means for steering the front shield vertically and sideways relative to the rear shield;

rear thrust ram means mounted on the rear tubular shield, said rear thrust ram means being extendible rearwardly to contact and push against the tunnel lining;

rotary cutterhead means carried by the front shield, which cutterhead means is of substantially the same diameter as the shields; and hydraulic cylinder means arranged to act extensibly between the front shield and the rear shield in an essentially tangential manner throughout the extent of relative axial movement of the shield and serving to transmit counter-rotational torque from the front shield back to the rear shield.

15. The tunneling machine of claim 11, wherein:

each of said torque cylinders comprising a cylindrical body connected to one of the front and rear shields, a piston connected to the other, said piston including a piston head inside the cylindrical body, a first fluid chamber formed on one side of the piston head, a second fluid chamber formed on the opposite side of the piston head, with the piston head presenting equal area faces towards each chamber; and conduit means connecting the first chamber of each torque cylinder of each pair with the second chamber of the other torque cylinder of the pair.

16. The tunneling machine of claim 3, wherein said linear fluid motors include a pair of fluid motors interconnected between the front and rear shields and located across the tunneling machine from each other.

17. The tunneling machine according to claim 7, wherein said torque cylinders include a pair of torque cylinders interconnected between the front and rear shields and located across the tunneling machine from each other.

18. The tunneling machine according to claim 11, wherein said torque cylinders include a pair of torque cylinders interconnected between the front and rear shields and located across the tunneling machine from each other.

19. A tunneling machine comprising:

telescopically arranged front and rear ground supporting tubular shields, each having a ground contacting outer surface, said outer surfaces being substantially identical in size and cross-sectional configuration;

full face rotary cutterhead means carried by said front shield;

radially expandible-contractible gripper means on said rear shield for gripping the tunnel wall to selectively anchor the rear shield against both axial and angular movement relative to the tunnel wall;

forward thrust ram means interconnected between the front and rear shields for shoving the front shield and cutterhead means axially forward relative to the rear shield while the rear shield is anchored in position by the gripper means to in this manner advance the tunneling means, said forward thrust ram means comprising several linear actuator means disposed in spaced relationship about the periphery of the front and rear shields;

means for selectively actuating the several linear acutator means at varying rates to coordinate the linear actuator means for steering the front shield vertically and sideways relative to the rear shield; and additional linear actuator means arranged to act extensibly between the front shield and the rear shield in an essentially tangential manner throughout the extent of relative axial movement of the shields and serving to transmit counter-rotational torque from the front shield back to the rear shield during rotation of the cutterhead means.

* * * * *